US005950394A

United States Patent [19]

Shaw et al.

[11] Patent Number: 5,950,394

[45] Date of Patent: Sep. 14, 1999

[54] METHOD OF FABRICATING DECORATIVE WALL

[76] Inventors: Lee A. Shaw, 1924 Irvine Ave., Newport Beach, Calif. 92660; Ronald D. Shaw, 1988 Pelican, Costa Mesa, Calif. 92626

[21] Appl. No.: 09/001,329

[22] Filed: Dec. 30, 1997

Related U.S. Application Data

[63] Continuation-in-part of application No. 08/906,286, Aug. 4, 1997, Pat. No. 5,887,399.

[51] Int. Cl.[6] ..... E04B 2/02; E04B 1/16

[52] U.S. Cl. ..... 52/741.13; 425/59; 405/267; 264/34; 249/78; 52/169.1; 52/311.1; 52/315; 52/318; 52/745.09; 52/742.14

[58] Field of Search ..... 52/741.13, 741.11, 52/169.1, 169.2, 311.1, 311.2, 315, 318, 612, 741.14, 742.14, 745.09; 264/31, 33, 34; 249/18, 33–35; 425/59; 405/267

[56] References Cited

U.S. PATENT DOCUMENTS

| | | |
|---|---|---|
| 348,443 | 8/1886 | Anderson . |
| 745,068 | 11/1903 | Menczarski . |
| 958,194 | 5/1910 | Thomas . |
| 1,397,678 | 11/1921 | Depaoli . |
| 1,534,353 | 4/1925 | Besser . |
| 2,101,540 | 12/1937 | Gullich . |
| 3,874,140 | 4/1975 | Seehusen . |
| 4,175,639 | 11/1979 | Wirt . |
| 5,492,434 | 2/1996 | Adams et al. ..... 405/36 |
| 5,887,399 | 3/1999 | Shaw et al. ..... 52/311.1 |

*Primary Examiner*—Robert Canfield
*Attorney, Agent, or Firm*—Stetina Brunda Garred & Brucker

[57] ABSTRACT

A constructed wall structure and method of fabrication that replicates a wall formed by nature. The structure has a plurality of discrete layers, with each layer constructed of concrete and a decorative additive. Every layer has an interface with an adjacent layer to thereby form a plurality of interfaces wherein at least one, and preferably most or all, of the interfaces are non-level. Non-limiting examples of decorative additives are rocks, sea shells, colorants, and mixtures thereof. Methodology for fabricating the wall structure includes pouring a first concrete mixture into a substantially vertical form which can be constructed as a channel within a generally elongate mound of a naturally occurring material and thereafter permitting a top surface of the concrete mixture to assume a non-level configuration. Preferably, a joint forming material is placed on the top surface of this first concrete mixture. In like manner, a second concrete mixture is poured on top of the first layer and a joint forming material is included. Additional layers can be added, with the concrete mixtures preferably including decorative additives that are exteriorly visible. After form removal by removing the mound, the entire wall or individual layers thereof can be subjected to an exterior treatment to enhance appearance.

10 Claims, 2 Drawing Sheets

METHOD OF FABRICATING DECORATIVE WALL

CROSS REFERENCE TO RELATED APPLICATION

This application is a continuation in part application of U.S. patent application Ser. No. 08/906,286, filed Aug. 4, 1997 now U.S. Pat. No. 5,887,399.

FIELD OF THE INVENTION

The present invention relates in general to decorative walls such as for landscaping and the like, and in particular to fabrication of a decorative wall having a plurality of discrete layers replicating a natural image to portray a naturally occurring wall structure.

BACKGROUND OF THE INVENTION

Many of the most desirable sights around the world are those formed by events caused over many years by the action of nature. Especially noteworthy are rock and stone wall formations created by centuries of erosion by water, by volcanic actions, or by other natural phenomena that expose a vertical face plane revealing a series of layers that represent respectively different mineral deposits, sedimentary accumulations, fossilized precipitates, and other naturally assembled matter. Evidence of the appeal of these natural attractions is apparent in the number of tourists who visit such places as the Rocky Mountains, Bryce Canyon, and other similar destinations in the United States every year.

While the pleasure of these attractions is formidable, on-going enjoyment for most people when their respective visitations are over is generally limited to viewing photographs of these naturally layered wall-like structures. Thus, and although such walls are naturally available at only relatively few locations where actual residence generally is not even available, it is believed that a bona fide replication of the appearance of such walls at sites selected by respective viewers is desirous. Accordingly, a primary object of the present invention is to fabricate a formed wall structure whose exteriorly visible vertical plane has a plurality of layers situated to replicate natural appearance.

Another object of the present invention is to fabricate a formed wall structure with discrete layer separations.

Yet another object of the present invention is to fabricate a formed wall structure wherein the plurality of layers differ from each other in appearance and can include visible shells, rocks, colorant, or other materials.

Yet another object of the present invention is to fabricate a formed wall structure using naturally occurring material as structural framework for construction.

These and other objects of the present invention will become apparent throughout the description thereof which now follows.

SUMMARY OF THE INVENTION

The present invention is a method of fabricating a formed wall structure comprising a plurality of discrete layers. Each of the layers of the structure comprises concrete, with at least one of such layers additionally comprising a decorative additive, and with each layer having an interface with an adjacent layer to thereby form a plurality of interfaces wherein at least one, and preferably most or all, of the plurality of interfaces are non-level. Non-limiting examples of decorative additives can be selected from the group consisting of rocks, sea shells, colorants, and mixtures thereof, while the exposed surface can be encompassed with a sealing material.

The method for fabricating the formed wall structure as defined above comprises pouring a first quantity of a first concrete mixture into a substantially vertical form comprising two generally opposing walls and permitting a top surface of the first concrete mixture to assume a non-level configuration. This substantially vertical form can be constructed of a naturally occurring material preferably situated at a site to be occupied by the decorative wall. In particular, the natural material at the site is first formed into a generally elongate mound having a length and height substantially equal to that desired for a finished decorative wall. Thereafter, a channel is formed as by excavation within and along the length of the mound of material at a depth equal to that desired for the finished decorative wall. The channel thus functions as a structural form in which the decorative wall is constructed.

Preferably, a joint forming material is placed on the top surface of the first concrete mixture poured into the channel as noted above to thereby form a first layer of the wall. In like manner, a second quantity of a second concrete mixture is poured on top of the first layer and permitted to assume a non-level configuration at its top surface. Once again, a joint forming material can be placed on the top to thereby complete formation of a second layer of the wall. One or more additional layers as desired can be added in the same way to thereby complete physical formation of the wall, with the concrete mixtures preferably including decorative additives that are exteriorly visible. After the layers of the wall have cured, the natural material is removed from both sides thereof and the entire wall or one or more individual layers thereof can be subjected to an exterior treatment such as etching, sand blasting, sponging, chipping, dusting on a color, applying a sealant, and combinations thereof. In this manner, aesthetically appealing wall structures can be provided for placement and enjoyment at critical sites for architectural as well as artistic functionality.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
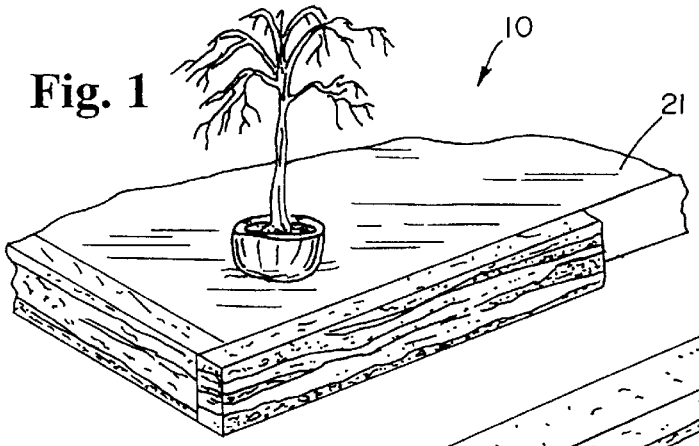
FIG. 1 is a perspective view of a portion of a multi-layer decorative wall structure.
Figure 2:
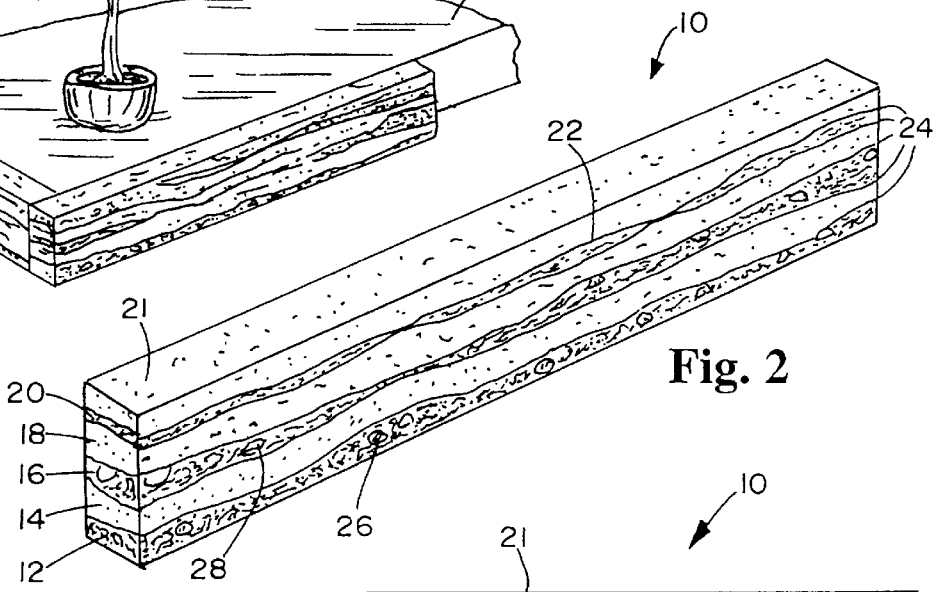
FIG. 2 is an enlarged perspective of the multi-layer decorative wall structure of FIG. 1.
Figure 3:
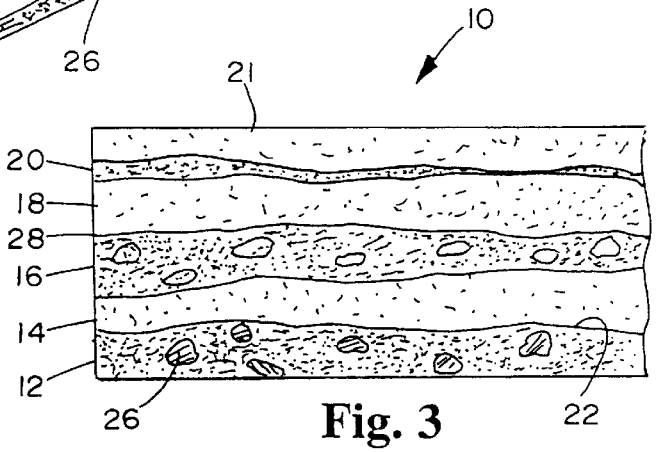
FIG. 3 is a side elevation view of the wall structure of FIGS. 1 and 2.

Referring to FIGS. 1–3, a multi-layer decorative wall structure 10 such as for outdoor architectural decor is shown.

The structure 10 has five decorative layers 12, 14, 16, 18, 20, topped with a finishing layer 21, each preferably separated from its next adjacent layer(s) by respective cold joints 22 preferably formed as later described with fiber mats coupled with vapor barriers. As is apparent, the respective tops 24 of each layer 12, 14, 16, 18, 20 are not level to thereby better replicate a naturally occurring wall structure with respect to its formation as such natural formation occurred over centuries. Decorative additives non-limitedly exemplified by sea shells 26 and rocks 28 appear respectively in layers 12, 16 to be exteriorly visible. Additionally, dust-on colorant as known in the art can be applied to one or more layers in one or more colors or color shades to further replicate a naturally occurring wall formation.

Figure 4:
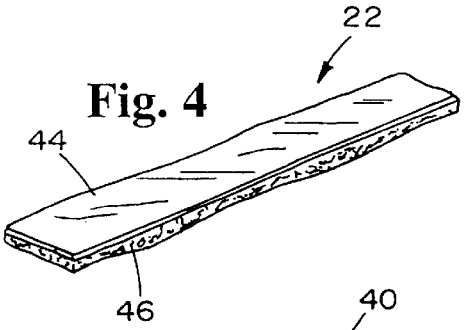
FIG. 4 is a perspective view of joint a forming material for placement between layers.
Figure 5:
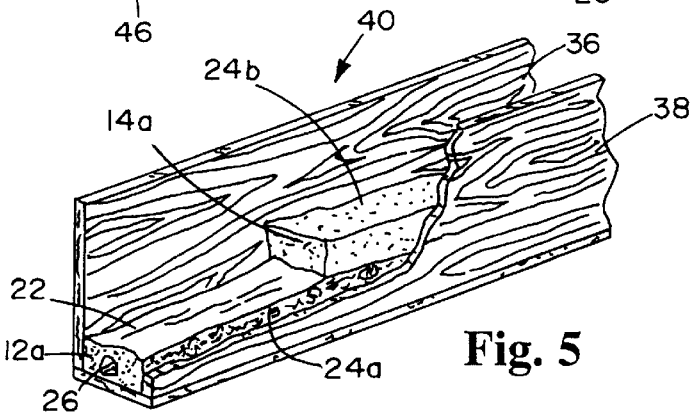
FIG. 5 is a perspective view of a form within which a multi-layer decorative wall structure is built.

Construction of the wall structure 10 is first exemplified in FIG. 5 wherein two conventional, opposing, generally-parallel plywood boards 36, 38 are provided to build a form 40 as known in the art between which the wall structure 10 is formed. Construction commences by pouring a first quantity of a first concrete mixture 12*a* into the form 40 to a variable depth averaging about two inches, but preferably with a non-level top surface 24*a*. The concrete mixture includes concrete along with a decorative additive here shown as sea shells 26 as earlier described, and such mixture can be mixed prior to pouring or it can be formulated during the pouring step by adding the decorative additive to the concrete as it is being poured into the form 40. Preferably, a cold-joint forming material 22 comprising a vapor barrier such as a plastic sheeting or Visqueen® 44 and standard fiber matting 46 (FIG. 4) is placed on the top surface 24*a* to enhance appearance of resulting layers through cold-joint formation. The layer 12 thus formed is allowed to at least partially set such that addition of a second layer there above will not cause significant disturbance of the top surface 24*a*.

When appropriate, a second concrete mixture 14*a* is introduced into the form 40 on top of the first layer 12 as shown. As with the concrete mixture 12*a*, the mixture 14*a* includes concrete along with a decorative additive (e.g. a colorant as known in the art) as desired. Once again, the top surface 24*b* of the second concrete mixture 14*a* is permitted to assume a non-level configuration. Likewise as described above with respect to the first layer 12, a cold--joint forming material is positioned on the top surface 24*b* of the second concrete mixture 14*a* within the form 40. Thereafter, additional layers as desired can be formed as illustrated in FIG. 2 to thereby complete construction of the wall structure 10. If the wall structure 10 is to be used as a support for one or more items to be placed thereon as exemplified in FIG. 1, a flat cover piece 21, here shown as concrete, but which can be made of wood or other material, is formed over the structure 10 as shown. Construction of the wall structure 10 can be accomplished at the site of desired placement, or it can be constructed off-site in sections as required for size considerations and thereafter delivered to the location of ultimate placement.

Figure 6:
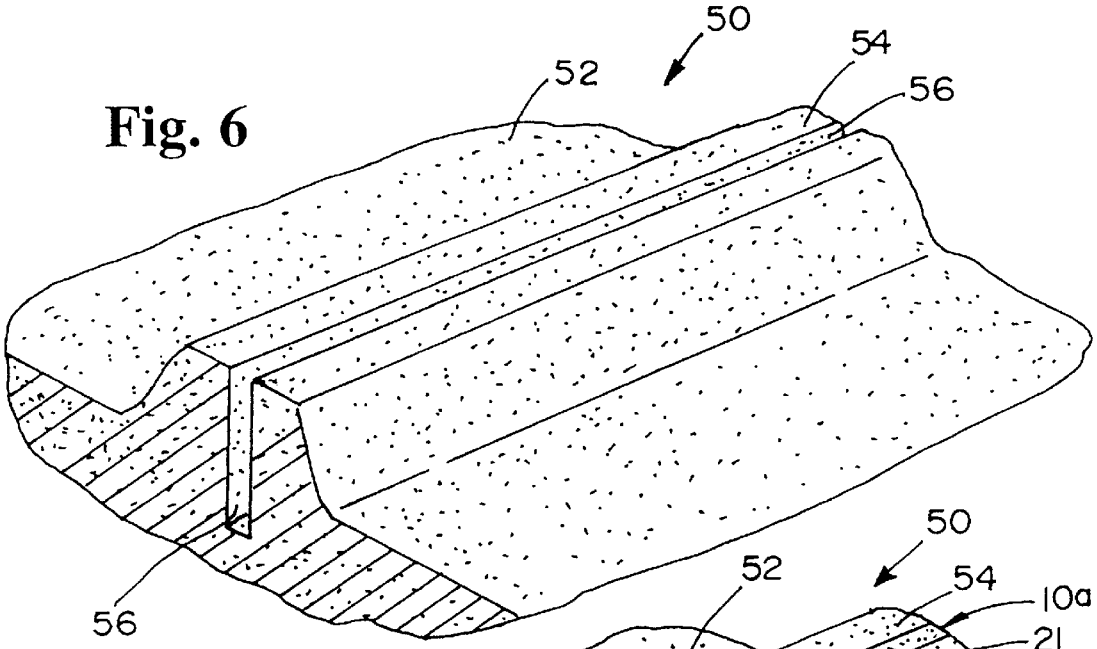
FIG. 6 is a perspective view of naturally occurring material formed into a generally elongate mound having a channel that functions as a structural form.
Figure 7:
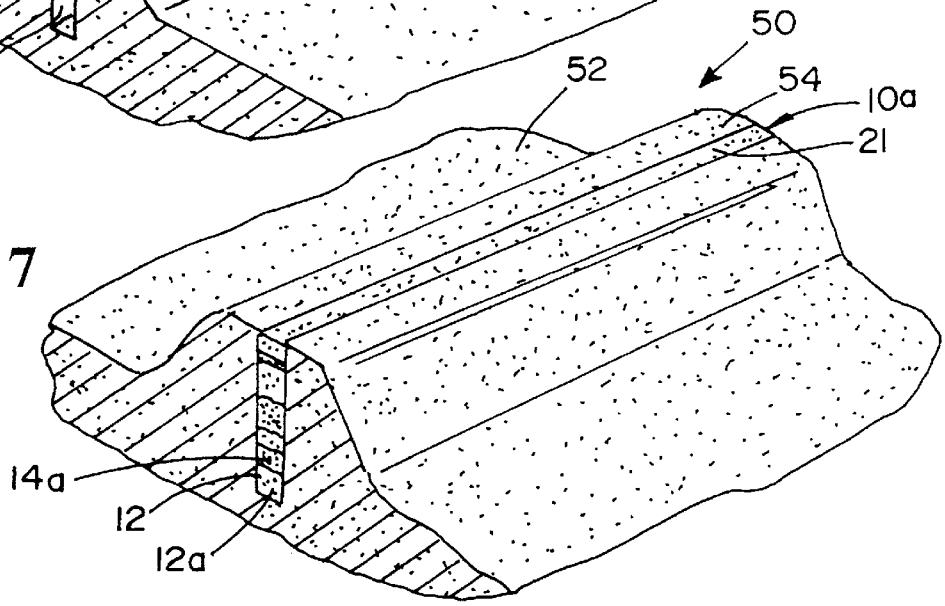
FIG. 7 is a perspective view of the mound of FIG. 6 within which a multi-layer decorative wall structure has been formed.
Figure 8:
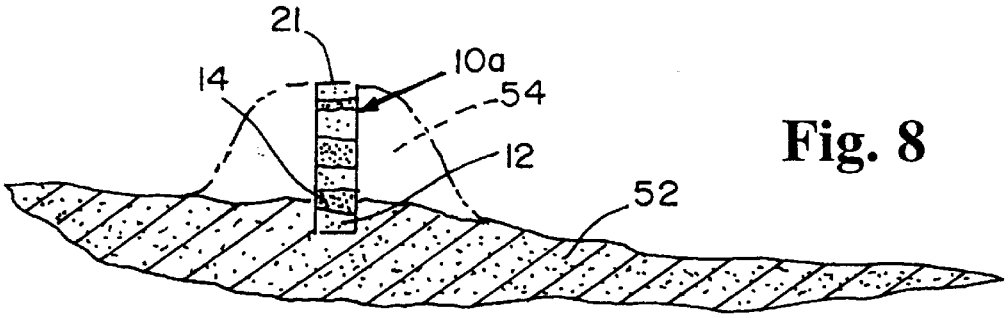
FIG. 8 is a cross sectional view of a formed decorative wall of FIG. 7.

FIGS. 6–8 exemplify a wall construction methodology wherein a substantially vertical form 50 can be constructed of a naturally occurring material 52 such as packed sand preferably situated at a site to be occupied by a multi-layer decorative wall structure 10*a*. In particular, the natural material 52 at the site is first formed into a generally elongate mound 54 having a length and height substantially equal to that desired for a finished decorative wall 10*a*. Thereafter, a channel 56 is formed as by excavation within and along the length of the mound 54 of material 52 at a depth equal to that desired for the finished decorative wall 10*a*. The channel 56 thus functions as a structural form in which the decorative wall 10*a* is constructed. Just as in the construction of the wall 10 as described above in relation to the form 40, a first quantity of a first concrete mixture 12*a* is poured into the channel 56 to a variable depth averaging about two inches, but preferably with a non-level top surface. The concrete mixture 12*a* includes concrete along with an optional decorative additive as earlier described, and such mixture 12*a* can be mixed prior to pouring or it can be formulated during the pouring step by adding the decorative additive to the concrete as it is being poured into the channel 56. Preferably, a cold-joint forming material comprising a vapor barrier such as a plastic sheeting or Visqueen® and standard fiber matting as described above is placed on the top surface of each layer to enhance appearance of resulting layers through cold-joint formation. The layer 12 thus formed is allowed to at least partially set such that addition of a second layer there above will not cause significant disturbance of its top surface.

As described above with respect to use of a plywood form 40, a second concrete mixture 14*a* is introduced into the channel 56 on top of the first layer 12 as shown to form a second layer 14. As with the concrete mixture 12*a*, the mixture 14*a* includes concrete along with a decorative additive as desired. Once again, the top surface of the second concrete mixture 14*a* is permitted to assume a non-level configuration. Likewise as described above with respect to the first layer 12, a cold-joint forming material is positioned on the top surface of the second concrete mixture 14*a* within the channel 56. Thereafter, additional layers as desired can be formed as illustrated in FIGS. 7 and 8 to thereby complete construction of the wall structure 10*a*. A cover 21 can be placed on the top of the wall 10*a* as described above in relation to the wall 10. Upon complete curing, the material 52 of the mound 54 is removed to thereby leave the wall 10*a* in place as shown in FIG. 8 which depicts the earlier-standing mound 54 in phantom lines. As earlier described, the exterior of the wall 10*a* can be subjected to an exterior treatment to further enhance its appearance.

As is apparent, the present invention provides a readily fabricated wall structure whose exteriorly visible vertical planes replicate the appearance of a naturally formed wall. While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A method of fabricating a wall structure having a plurality of layers, the method comprising:

a) pouring a first quantity of a first concrete mixture into a substantially vertical form comprising a channel disposed within a generally elongate mound of a naturally occurring material and permitting a top surface of the first concrete mixture to assume a non-level configuration;

b) pouring a second quantity of a second concrete mixture on top of the first layer and permitting a top surface of the second concrete mixture to assume a non-level configuration;

c) pouring at least one additional quantity of at least one additional concrete mixture and permitting a top surface of the at least one additional concrete mixture to assume a non-level configuration; and d) removing the material of the generally elongate mound.

2. A method of fabricating a wall structure having a plurality of layers, the method comprising:

a) pouring a first quantity of a first concrete mixture into a substantially vertical form comprising a channel disposed within a generally elongate mound of a naturally occurring material and permitting a top surface of the first concrete mixture to assume a non-level configuration;

b) placing a joint forming material on the top surface of the first concrete mixture to thereby form a first layer of said wall;

c) pouring a second quantity of a second concrete mixture on top of the first layer and permitting a top surface of the second concrete mixture to assume a non-level configuration;

d) placing a joint forming material on the top surface of the second concrete mixture to thereby form a second layer of said wall;

e) pouring at least one additional quantity of at least one additional concrete mixture and permitting a top surface of the at least one additional concrete mixture to assume a non-level configuration;

f) placing a joint forming material on the top surface of the at least one additional concrete mixture to thereby form at least one additional layer; and g) removing the material of the generally elongate mound.

3. A method of fabricating a wall structure as claimed in claim 2 comprising in addition a surface treatment of an exterior surface of at least one layer of the wall.

4. A method of fabricating a wall structure as claimed in claim 3 wherein the surface treatment is selected from the group consisting of etching, sand blasting, sponging, chipping, dusting on a color, applying a sealant, and combinations thereof.

5. A method of fabricating a wall structure as claimed in claim 4 wherein each of the concrete mixtures comprises concrete and a decorative additive at least partially visible from an exterior site of the wall.

6. A method of fabricating a wall structure as claimed in claim 5 wherein the decorative additive is selected from the group consisting of rocks, sea shells, colorant, and mixtures thereof.

7. A method of fabricating a wall structure as claimed in claim 5 wherein the decorative additive is added to the concrete as said concrete is being poured into the form.

8. A method of fabricating a wall structure as claimed in claim 2 wherein each of the concrete mixtures comprises concrete and a decorative additive at least partially visible from an exterior site of the wall.

9. A method of fabricating a wall structure as claimed in claim 8 wherein the decorative additive is selected from the group consisting of rocks, sea shells, colorant, and mixtures thereof.

10. A method of fabricating a wall structure as claimed in claim 9 wherein the decorative additive is added to the concrete as said concrete is being poured into the form.

* * * * *